United States Patent [19]

Henry

[11] 4,316,867

[45] Feb. 23, 1982

[54] PROCESS FOR REMOVING IMPURITIES FROM POLYMER SOLUTIONS

[75] Inventor: James W. Henry, Kingsport, Tenn.

[73] Assignee: Eastman Kodak Company, Rochester, N.Y.

[21] Appl. No.: 83,485

[22] Filed: Oct. 10, 1979

[51] Int. Cl.[3] ..... D01D 1/10

[52] U.S. Cl. ..... 264/169; 106/169; 106/187; 106/196; 264/207

[58] Field of Search ..... 264/169, 200, 207; 106/196, 198, 169, 187

[56] References Cited

U.S. PATENT DOCUMENTS

| | | | |
|---|---|---|---|
| 2,541,012 | 2/1951 | Bruins et al. | 106/198 |
| 2,798,542 | 7/1957 | Drewitt et al. | 264/207 |
| 2,858,228 | 10/1958 | Hughes | 106/196 |
| 2,858,229 | 10/1958 | Hughes | 106/196 |
| 2,925,353 | 2/1960 | Mika et al. | 106/196 |
| 2,966,422 | 12/1960 | Braudner | 106/196 |
| 2,972,546 | 2/1961 | Adler et al. | 106/198 |
| 3,847,885 | 11/1974 | Peeso | 260/29.6 AN |
| 4,174,417 | 11/1979 | Rydell | 269/207 |

FOREIGN PATENT DOCUMENTS

| | | | |
|---|---|---|---|
| 52-18923 | 2/1977 | Japan | 264/182 |

OTHER PUBLICATIONS

"Chem. Engin. Handbook", by Perry et al., pp. 11-13, 11-33 and 11-34, McGraw Hill, Fifth Ed., Science Lib. PTO.

*Primary Examiner*—Jay H. Woo

*Attorney, Agent, or Firm*—John F. Stevens; Daniel B. Reece, III

[57] ABSTRACT

A continuous process is disclosed for treating a viscous polymer solution prior to being introduced into a spinnerette for producing fibers. The treatment comprises:

(a) introducing a volatile viscosity reducing agent into the solution to render the solution suitable for centrifuging, (b) passing the solution of reduced viscosity through a centrifuge wherein gels are centrifugally separated from the solution, (c) evaporating volatile viscosity reducing agent from the solution to render it suitable for spinning, (d) condensing the viscosity reducing agent and capturing the heat of condensation, and (e) using the heat from step (d) as at least a part of the heat required for evaporating the viscosity reducing agent.

5 Claims, No Drawings

PROCESS FOR REMOVING IMPURITIES FROM POLYMER SOLUTIONS

BACKGROUND OF THE INVENTION

1. Field of the Invention

This invention relates to a process for removing gels from polymer solutions, and in paticular, cellulose ester solutions.

2. Description of the Prior Art

When polymers are dissolved in solvents to form spinning solutions, it is commonly found that the solution contains small gels which are objectionable from a quality standpoint. Such gels are usually caused by impurities in the polymer. For example, in cellulose esters such as cellulose acetate, there are frequently very small quantities of cellulose triacetate present. When the cellulose acetate is dissolved in a conventional solvent such as acetone prior to being spun into fibers, the cellulose triacetate present as an impurity is not soluble in the acetone, but instead forms a gel. Such gels, if not removed, may block spinnerette holes, or if they pass through the spinnerette holes, objectionable flaws in products such as fibers may result from the presence of the cellulose triacetate.

In the past, various types of filters have been used in attempts to remove these gels. It has now been discovered, however, that filtering the solution is not an effective means for removing the gels, because many gels will break up into fragments tiny enough to pass through the filter and agglommerate to form new gels downstream from the filter.

It is also well known, of course, that various types of relatively heavy masses may be separated from lighter liquids by centrifuging batches of the liquid containing the heavier masses.

SUMMARY OF THE INVENTION

In accordance with the present invention, a continuous process is provided wherein a viscous polymer solution is introduced into a spinnerette for producing a filament. The process comprises the steps of (a) introducing a volatile viscosity reducing agent into the solution to render the solution suitable for centrifuging, (b) passing the solution of reduced viscosity through a centrifuge wherein gels are centrifugally separated from the solution, (c) evaporating some of the volatile viscosity reducing agent from the solution to render it suitable for spinning, (d) condensing the viscosity reducing agent and capturing the heat of condensation, and (e) using the heat from step (d) as at least a part of the heat required for evaporating the viscosity reducing agent.

DETAILED DESCRIPTION OF THE INVENTION

The present invention provides a convenient method of removing impurities from polymer solutions. An important application of the present invention is in the removal of gels from cellulose ester spinning solutions, and the invention will be described herein with particular reference thereto. Common cellulose esters include cellulose acetate, cellulose butyrate, cellulose propionate, and mixed esters such as cellulose acetate butyrate and cellulose acetate propionate. Solutions of all of these esters are subject to containing gels such as cellulose triacetate, or higher orders of esterified cellulose materials.

According to the invention, the cellulose ester solution, commonly referred to as dope, is first thinned by mixing therewith a compatable volatile viscosity reducing agent. Dope which is ready to be spun usually contains about 20–28 weight percent solids. It is preferred to reduce the viscosity of the dope by simply adding more solvent. The solvent is normally acetone. The viscosity reducing agent is added to the dope using a conventional mixing apparatus at temperatures of about 100°–120° F. Sufficient viscosity reducing agent is added to render the solution suitable for centrifuging. The diluted dope in acetone would have at this point a solids content of about 5 to about 10 weight percent.

The diluted dope is next fed to a continuous centrifuge where the centrifugal forces act to separate the heavier gels from the solution. Continuous centrifuges are commercially available such as, for example, the Sharples air driven unit capable of speeds to 50,000 rpm is useful. Speeds of from about 30,000 to about 75,000 are suitable in the majority of these units, wherein a force of about 100–400 gs is attained, and the residence time of the solution in the centrifuge is from about 1 to about 5 minutes. The gels removed from the solution are discarded, and the dilute, gel-free dope is next passed to an evaporator where heat is applied to evaporate sufficient viscosity reducing agent to result in a relatively concentrated dope containing about 20–28 weight percent solids. The temperature of the dope in the evaporator is about 110° to about 150° F. The dope is next cooled to a suitable spinning temperature of about 120° F. and fed to the spinning apparatus.

Viscosity reducing agent evaporated from the dope in the evaporator is condensed and recycled by mixing with concentrated dope just upstream from the centrifuge. In the case of acetone being used as the viscosity reducing agent, the condenser is operated at a temperature of about 45°–55° F. Heat given up at the condenser is captured and utilized as at least a part of the heat applied at the evaporator. Make-up may be added as required to the evaporator.

The following example is submitted for a better understanding of the invention.

A solution of about 25 weight percent cellulose acetate dissolved in acetone is mixed with additional acetone at 110° F. to provide a dilute solution containing about 8 weight percent cellulose acetate. The dilute solution is fed to a Sharples centrifuge operating at a speed of about 42,000 rpm. The residence time of the solution in the centrifuge is about 5 minutes. Gels of heavier cellulose triacetate are centrifuged out of the solution, and the dilute, gel-free dope is fed to an evaporator operating at a temperature of about 140° F. Acetone is evaporated to reconcentrate the dope so that it again contains about 25 weight percent cellulose acetate. The gel-free dope is then fed to spinning apparatus.

The evaporated acetone is fed to a condenser operating at about 50° F., and the liquid acetone is recirculated as feed to the incoming cellulose acetate which contains gels of cellulose triacetate. Liquid from the heat exchanger in the condenser is circulated to a heat exchanger in the evaporator to aid in heating the solution to evaporate acetone. Additional heat is required to raise the evaporator to an operating temperature of 140° F.

The invention has been described in detail with particular reference to certain preferred embodiments thereof, but it will be understood that variations and modifications can be effected within the spirit and scope of the invention.

I claim:

1. In a continuous process wherein cellulose ester solution is introduced into a spinnerette for producing a filament therefrom, the improvement which comprises (a) introducing a volatile viscosity reducing agent into said solution to render the solution suitable for centrifuging, (b) passing said solution of reduced viscosity through a centrifuge wherein gels are centrifugally separated from the solution, (c) evaporating volatile viscosity reducing agent from said solution to render it suitable for spinning, (d) condensing the viscosity reducing agent and capturing the heat of condensation, and (e) using the heat from step (d) as at least a part of the heat required for evaporating the viscosity reducing agent.

2. In a continuous process according to claim 1, the improvement wherein the viscosity reducing agent is acetone.

3. In a continuous process according to claim 1, the improvement wherein said cellulose ester solution is reduced in solids content in step (a) from about 20–28 weight percent to about 5–10 weight percent.

4. In a continuous process according to claim 1, the improvement wherein the solution in the centrifuge is accelerated to attain a gravity force of from about 100 to about 400 g.

5. In a continuous process according to claim 1, the improvement wherein the residence time of said solution in the centrifuge is from about 1 to about 5 minutes.

* * * * *